US009484633B2

(12) United States Patent
Oh

(10) Patent No.: US 9,484,633 B2
(45) Date of Patent: Nov. 1, 2016

(54) LOOP ANTENNA HAVING A PARASITICALLY COUPLED ELEMENT

(71) Applicant: Nokia Technologies Oy, Espoo (FI)

(72) Inventor: Sung-Hoon Oh, Cupertino, CA (US)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/438,476

(22) PCT Filed: Oct. 26, 2012

(86) PCT No.: PCT/IB2012/055928
§ 371 (c)(1),
(2) Date: Apr. 24, 2015

(87) PCT Pub. No.: WO2014/064490
PCT Pub. Date: May 1, 2014

(65) Prior Publication Data
US 2015/0295314 A1 Oct. 15, 2015

(51) Int. Cl.
*H01Q 21/00* (2006.01)
*H01Q 19/00* (2006.01)
*H01Q 7/00* (2006.01)
*H01Q 1/24* (2006.01)
(Continued)

(52) U.S. Cl.
CPC ..... *H01Q 7/00* (2013.01); *H01Q 1/243* (2013.01); *H01Q 5/378* (2015.01); *H01Q 9/42* (2013.01); *H01Q 21/0006* (2013.01); *H01Q 21/0087* (2013.01)

(58) Field of Classification Search
CPC ..... H01Q 7/00; H01Q 1/243; H01Q 5/378; H01Q 21/0087
See application file for complete search history.

(56) References Cited

U.S. PATENT DOCUMENTS 7,808,442 B2 * 10/2010 Chiu ..... H01Q 1/243 343/826
8,552,919 B2 * 10/2013 Hsieh ..... H01Q 1/243 343/722

(Continued)

FOREIGN PATENT DOCUMENTS

CN 102122760 A 7/2011
CN 102255134 A 11/2011
WO 2010122220 A1 10/2010

OTHER PUBLICATIONS

International Search Report and Written Opinion received for corresponding Patent Cooperation Treaty Application No. PCT/IB2012/055928, dated Jun. 18, 2013, 9 pages.

(Continued)

*Primary Examiner* — Trinh Dinh
(74) *Attorney, Agent, or Firm* — Nokia Technologies Oy

(57) ABSTRACT

An antenna, a portable electronic device incorporating an antenna and a method of operation are provided to enable both wide and multiple frequency band response. The antenna may include a feeding arm and a parasitic element. The feeding arm may include a conductive loop antenna and a conductive excitation arm portion. The loop antenna portion may extend from a first end that is configured to be grounded to a second end that is configured to be driven by radio frequency circuitry. The excitation arm may be coupled at a first end to the loop antenna portion and extend outwardly therefrom to an open end. The parasitic element may extend from a first end is configured to be grounded to a second end that is open. The parasitic element may extend along opposite sides of the excitation arm portion so as to be coupled thereto.

17 Claims, 10 Drawing Sheets

(51) Int. Cl.
*H01Q 5/378* (2015.01)
*H01Q 9/42* (2006.01)

(56) References Cited

U.S. PATENT DOCUMENTS

| | | | | |
|---|---|---|---|---|
| 8,654,026 | B2 * | 2/2014 | Tsai | H01Q 1/243 343/700 MS |
| 2004/0108957 | A1 | 6/2004 | Umehara et al. | |
| 2004/0113847 | A1 | 6/2004 | Qi et al. | |
| 2008/0136711 | A1 | 6/2008 | Lai et al. | |
| 2009/0295646 | A1 | 12/2009 | Oh et al. | |
| 2010/0177004 | A1 | 7/2010 | Shih et al. | |
| 2011/0043421 | A1 * | 2/2011 | Hsieh | H01Q 1/243 343/729 |
| 2011/0183633 | A1 | 7/2011 | Ohba et al. | |
| 2011/0309986 | A1 | 12/2011 | Ying | |
| 2012/0105287 | A1 | 5/2012 | Jung et al. | |
| 2012/0194390 | A1 | 8/2012 | Endo et al. | |
| 2012/0242555 | A1 * | 9/2012 | Hsieh | H01Q 1/243 343/833 |
| 2012/0249393 | A1 | 10/2012 | Hotta et al. | |
| 2012/0299781 | A1 * | 11/2012 | Lee | H01Q 5/35 343/700 MS |
| 2015/0009087 | A1 * | 1/2015 | Lee | H01Q 1/243 343/866 |
| 2015/0207219 | A1 * | 7/2015 | Oh | H01Q 1/48 343/702 |

OTHER PUBLICATIONS

Chen et al., "Printed Coupled-Fed PIFA for Seven-Band GSM/UMTS/LTE WWAN Mobile Phone", Journal of Electromagnetic Waves and Applications, vol. 26, No. 2, Jan. 2012, pp. 390-401.

Extended European Search Report received for corresponding European Patent Application No. 12887110.0, dated Apr. 5, 2016, 8 pages.

* cited by examiner

LOOP ANTENNA HAVING A PARASITICALLY COUPLED ELEMENT

RELATED APPLICATION

This application was originally filed as Patent Cooperation Treaty Application No. PCT/IB2012/055928 filed Oct. 26, 2015.

TECHNOLOGICAL FIELD

An example embodiment of the present invention relates generally to an antenna and, more particularly, to a loop antenna having a parasitically coupled element.

BACKGROUND

Portable electronic devices, such as cellular telephones, smartphones, tablet computers, laptop computers, personal digital assistants (PDAs), gaming devices, navigation systems, audio devices, video devices, camera devices and the like, frequently include one or more antennas so as to facilitate wireless communication. Portable electronic devices generally include a housing with one or more antennas positioned within, on or as part of the housing. As a result of the continued emphasis upon the reduction in the size of portable electronic devices, the volume within the housing of a portable electronic device that may be filled by an antenna is generally correspondingly limited.

Portable electronic devices increasingly require antennas having both a wide bandwidth and multiple frequency bands. In this regard, portable electronic devices may require antennas to have wide and multiple bands in order to support wireless communication in many operational frequency bands, such as the pentaband and the frequency bands utilized for global positioning systems (GPS). However, the gain and bandwidth of an antenna is limited by its electrical size as measured in wavelength. As such, the development of an antenna having wide and multiple bands may be limited in the context of antennas designed from use in portable electronic devices by the countervailing design objective to develop antennas that are no larger and, more preferably, smaller than the antennas currently deployed in portable electronic devices.

BRIEF SUMMARY

An antenna, a portable electronic device incorporating an antenna and a method of operation are provided in accordance with example embodiments of the present invention. In this regard, an antenna may be designed in accordance with one embodiment of the present invention so as to enable both wide and multiple frequency band response without necessarily increasing the size of the antenna. As such, the antenna of one embodiment of the present invention may be utilized by portable electronic devices so as to provide the desired wide band performance suitable for many operational frequency bands, including, for example, the pentaband and the frequency bands utilized for GPS, while remaining relatively small in size.

In one embodiment, an antenna is provided that includes a feeding arm and a parasitic element. The feeding arm includes a conductive loop antenna and an elongated conductive excitation arm portion. The feeding arm and the parasitic element can be considered to be radiating elements. The loop antenna portion extends from a first end that is configured to be grounded to a second end that is configured to be driven by radio frequency circuitry. It should be appreciated by those skilled in the art that an antenna arrangement is coupled to radio frequency circuitry and configured to receive and/or transmit electromagnetic radio frequency waves or signals, and thus being driven by radio frequency circuitry applies also to receiving radio frequency signals at the antenna arrangement, the RF signals being received by the radio frequency circuitry and a corresponding receiver front-end. The excitation arm is coupled at a first end to the loop antenna portion and extends outwardly therefrom to an open end. The parasitic element includes a first end that is configured to be grounded and a second end configured to be open. The parasitic element extends from the first end to the second end. The parasitic element extends along opposite sides of the excitation arm portion so as to wrap at least partially about the excitation arm portion and be coupled thereto. For example, the parasitic element may extend along a majority of each of the opposite sides of the excitation arm portion so as to wrap about a substantial periphery of the excitation arm portion. However, the parasitic element of one embodiment is only wrapped about the excitation arm portion.

The second end of the parasitic element may be proximate to an intermediate segment of the loop antenna portion between the first and second ends. In this embodiment, the intermediate segment may be proximate to the first end of the excitation arm portion. The antenna of one embodiment also includes a ground plane coupled to the first end of the loop antenna portion and the first end of the parasitic element. In this embodiment, the ground plane defines a surface area that extends to the first end of the loop antenna portion and the first end of the parasitic element with other portions of the feeding arm and the parasitic element extending beyond the surface area of the ground plane. The first end of the excitation arm portion may be coupled to the loop antenna portion at a location closer to the second end than to the first end of the antenna portion. In one embodiment, the loop antenna portion of one embodiment is a magnetic field dominant radiation structure, while both the excitation arm portion and the parasitic element are predominantly electric field radiated structures.

In another embodiment, a portable electronic device is provided that includes the apparatus of the foregoing embodiments. A module is provided in accordance with another embodiment which includes an apparatus of the foregoing embodiments.

In a further embodiment, a method is provided that includes providing an antenna that includes a feeding arm and a parasitic element. The feeding arm includes a conductive loop antenna portion and an elongated conductive excitation arm portion. The loop antenna portion extends from a first end that is grounded to a second end. The excitation arm portion is coupled at a first end to the loop antenna portion and extends outwardly therefrom to an open end. The parasitic element extends from a first end that is grounded to a second end that is open. The parasitic element extends along opposite sides of the excitation arm portion so as to wrap at least partially about the excitation arm portion and be coupled thereto. The method of this embodiment also includes coupling radio frequency signals to the second end of the loop antenna portion.

In one embodiment, the antenna is provided such that the parasitic element extends along a majority of each of the opposite sides of the excitation arm portion so as to be wrapped about a substantial periphery of the excitation arm portion. However, the antenna that is provided may be such that the parasitic element is only wrapped about the excitation arm portion. In one embodiment, the antenna is provided such that the second end of the parasitic element is proximate an intermediate segment of the loop antenna portion between the first and second ends. The intermediate segment may be proximate the first end of the excitation arm portion. The antenna that is provided may further include a ground plane that is coupled to the first end of the loop antenna portion and to the first end of the parasitic element. In this embodiment, the ground plane defines a surface area that extends to the first end of the loop antenna portion and the first end of the parasitic element with other portions of the feeding arm and the parasitic element extending beyond the surface area of the ground plane. In one embodiment, the antenna is provided such that the first end of the excitation arm portion is coupled to the loop antenna portion at a location closer to the second end than to the first end of the loop antenna portion.

BRIEF DESCRIPTION OF THE DRAWINGS

Figure 1:
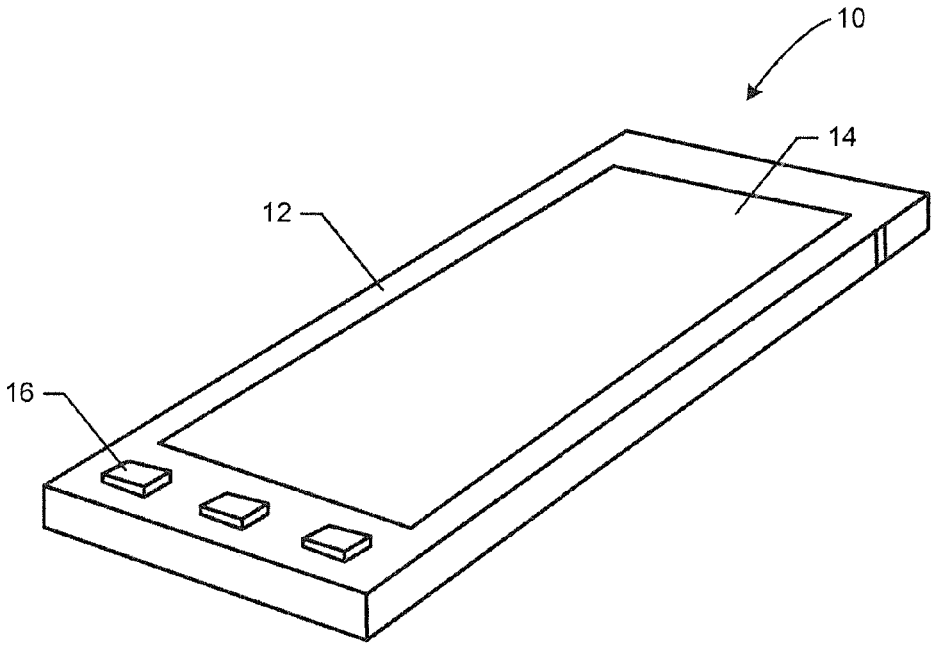
Figure 2:
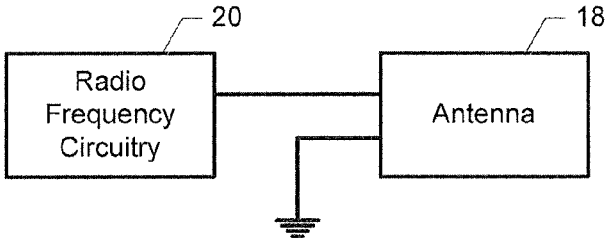
Figure 3:
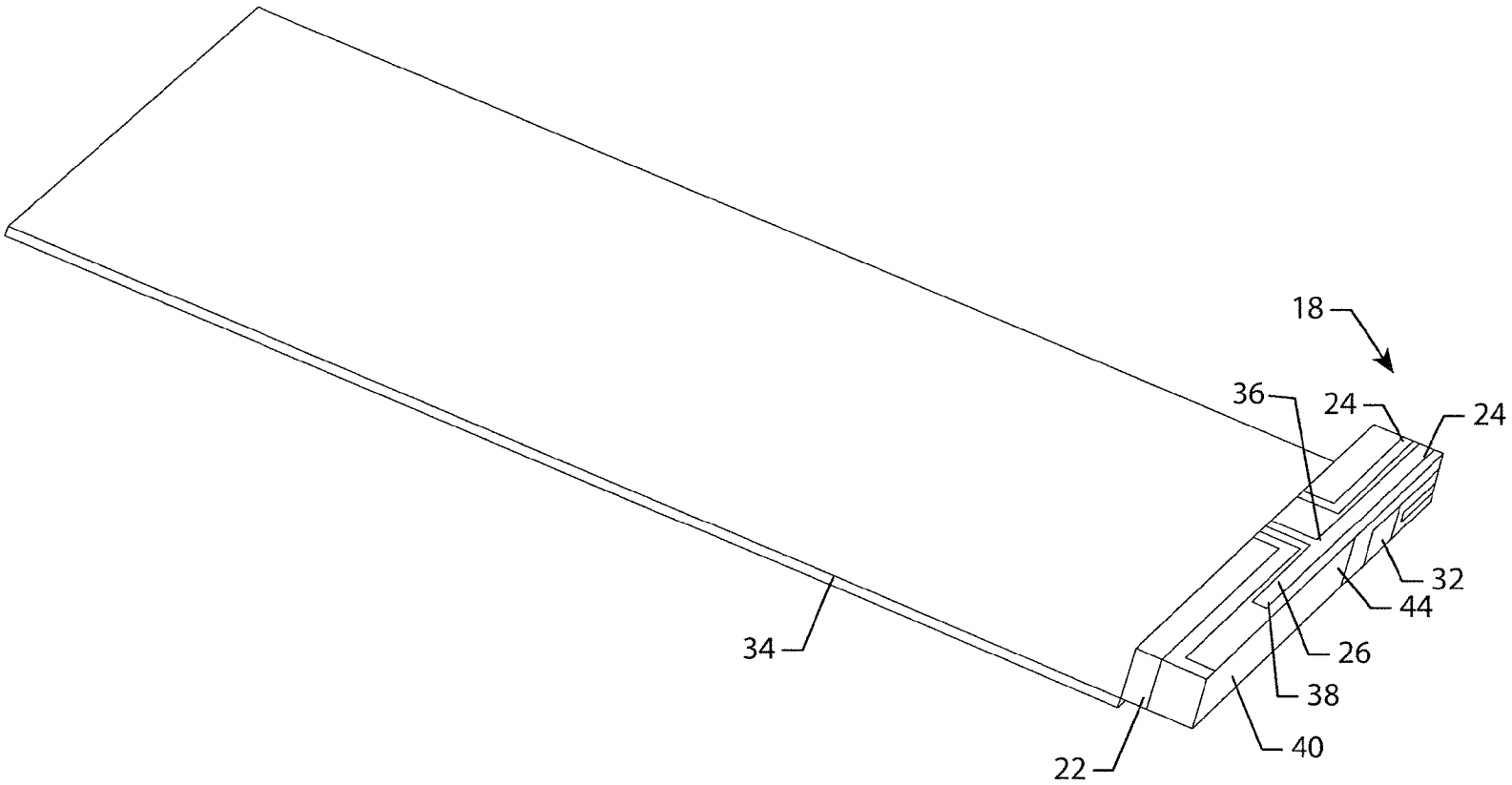
Figure 4:
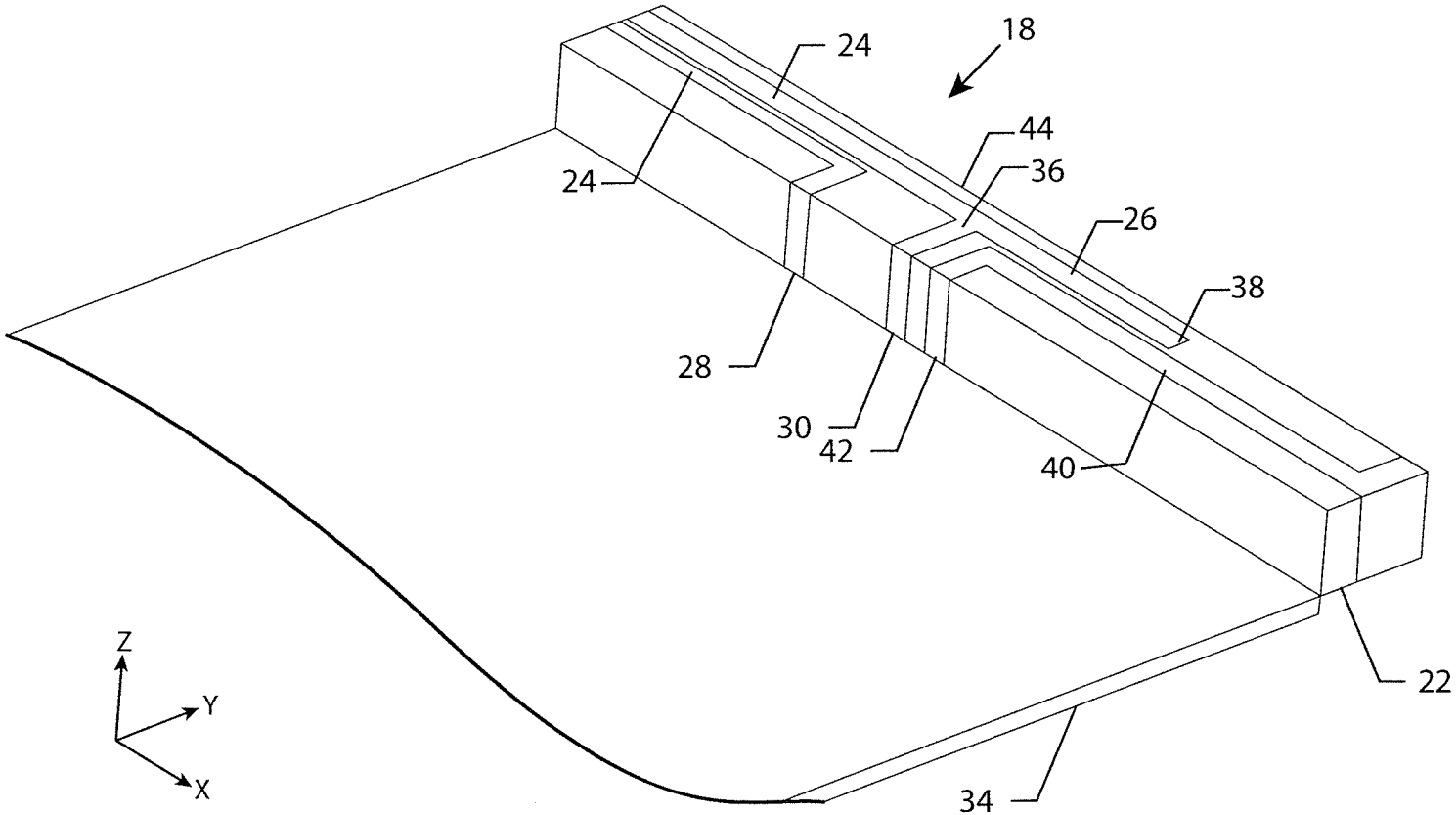
Figure 5:
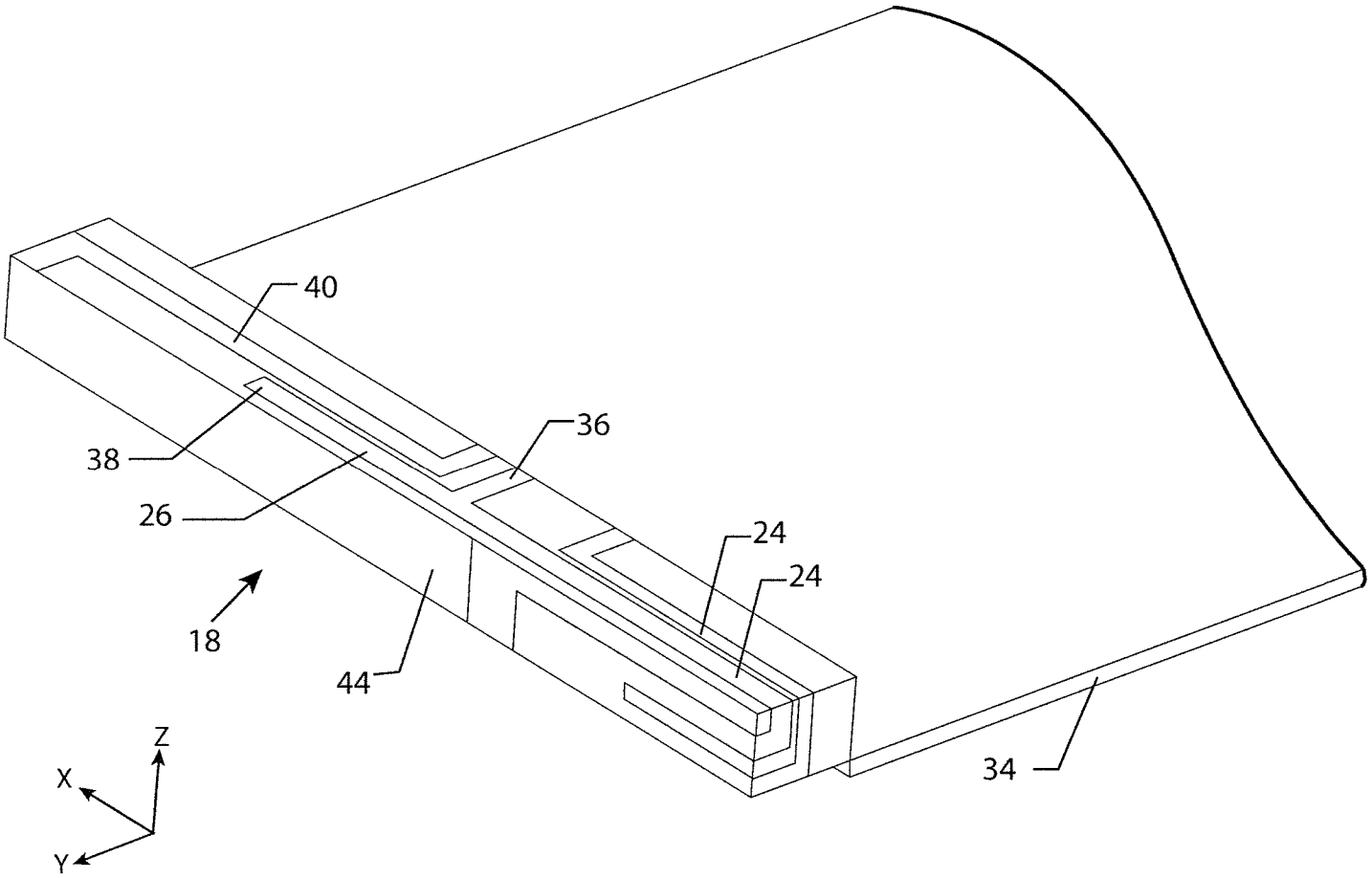
Figure 6:
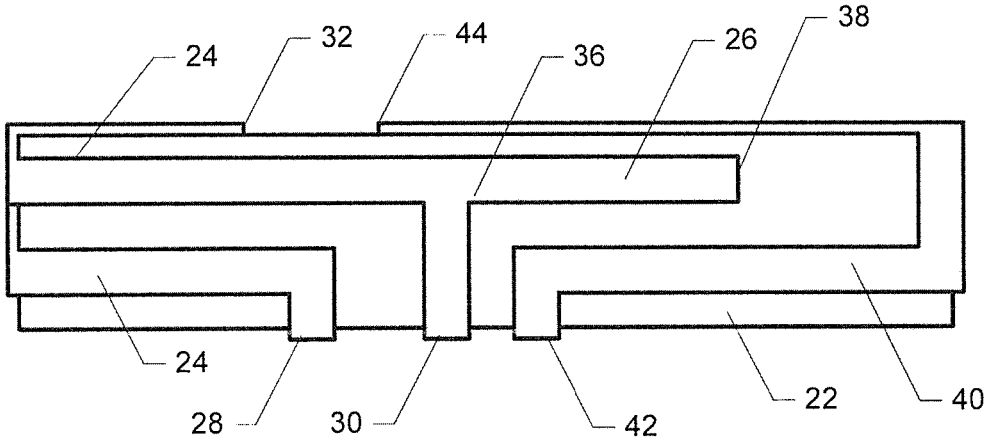
Figure 7:
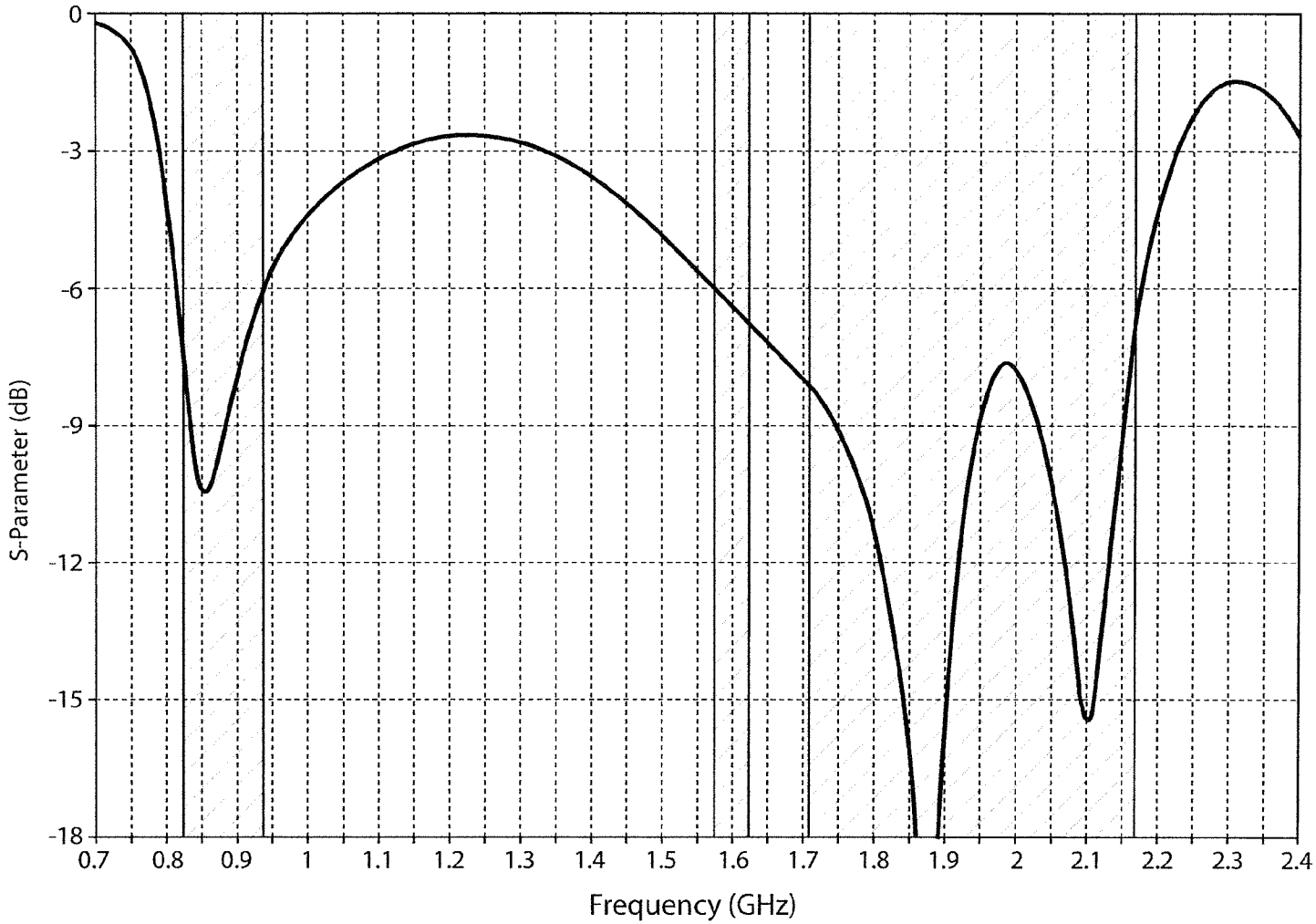
Figure 8:
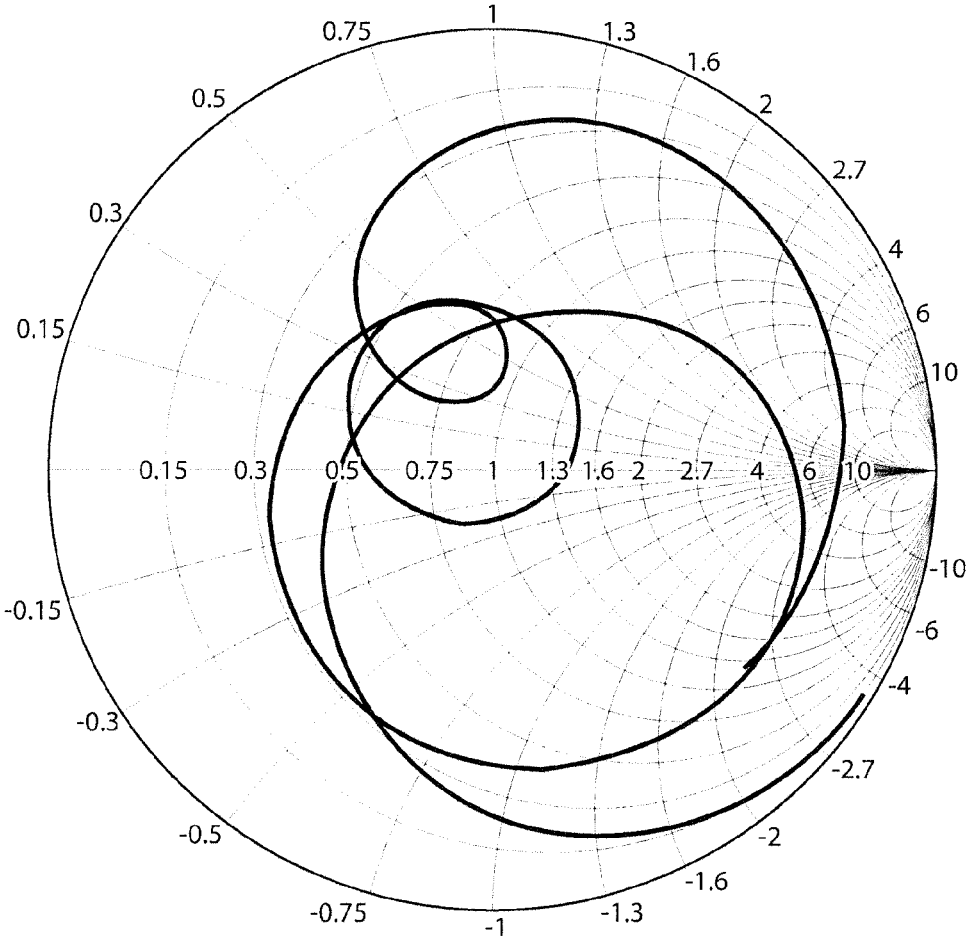
Figure 9:
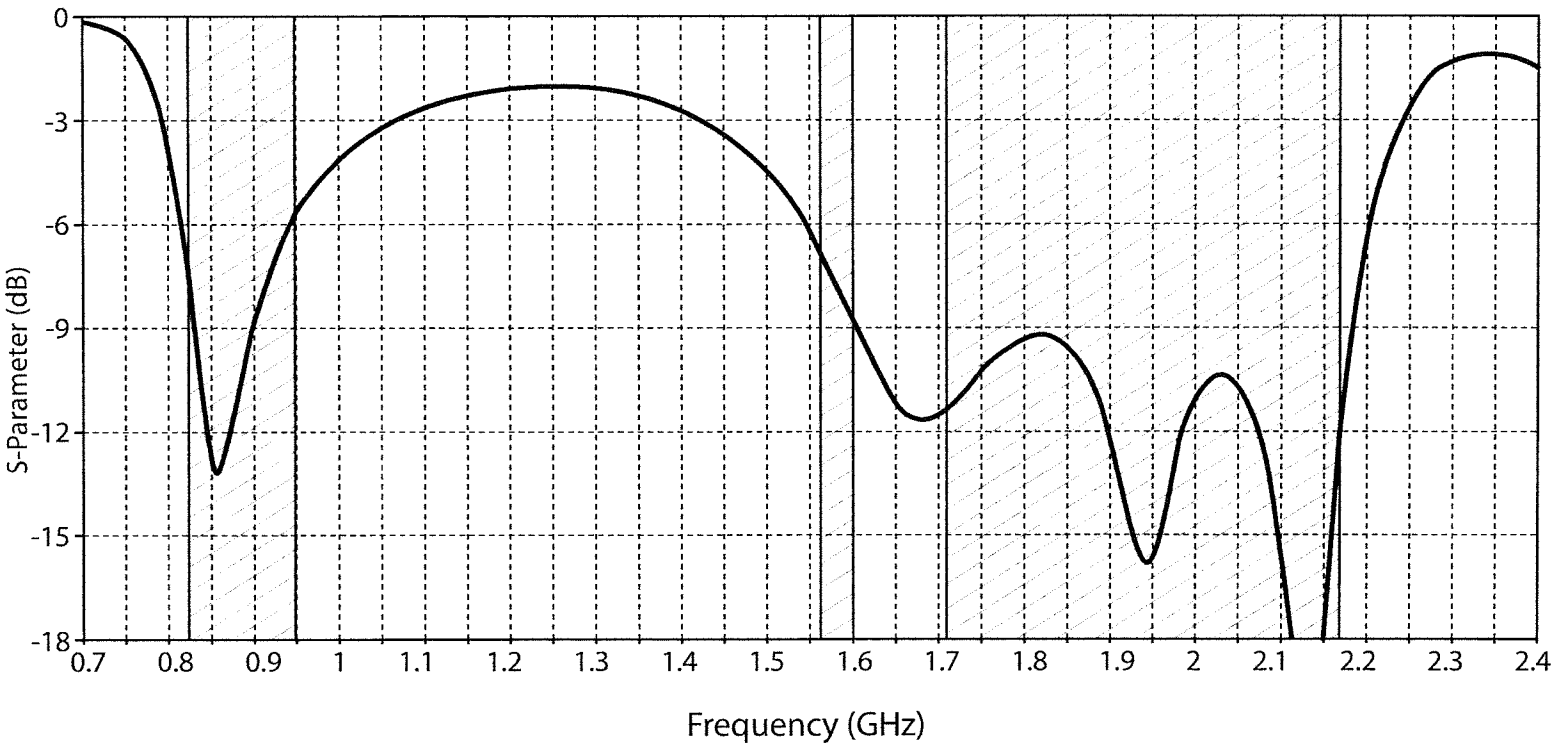
Figure 10:
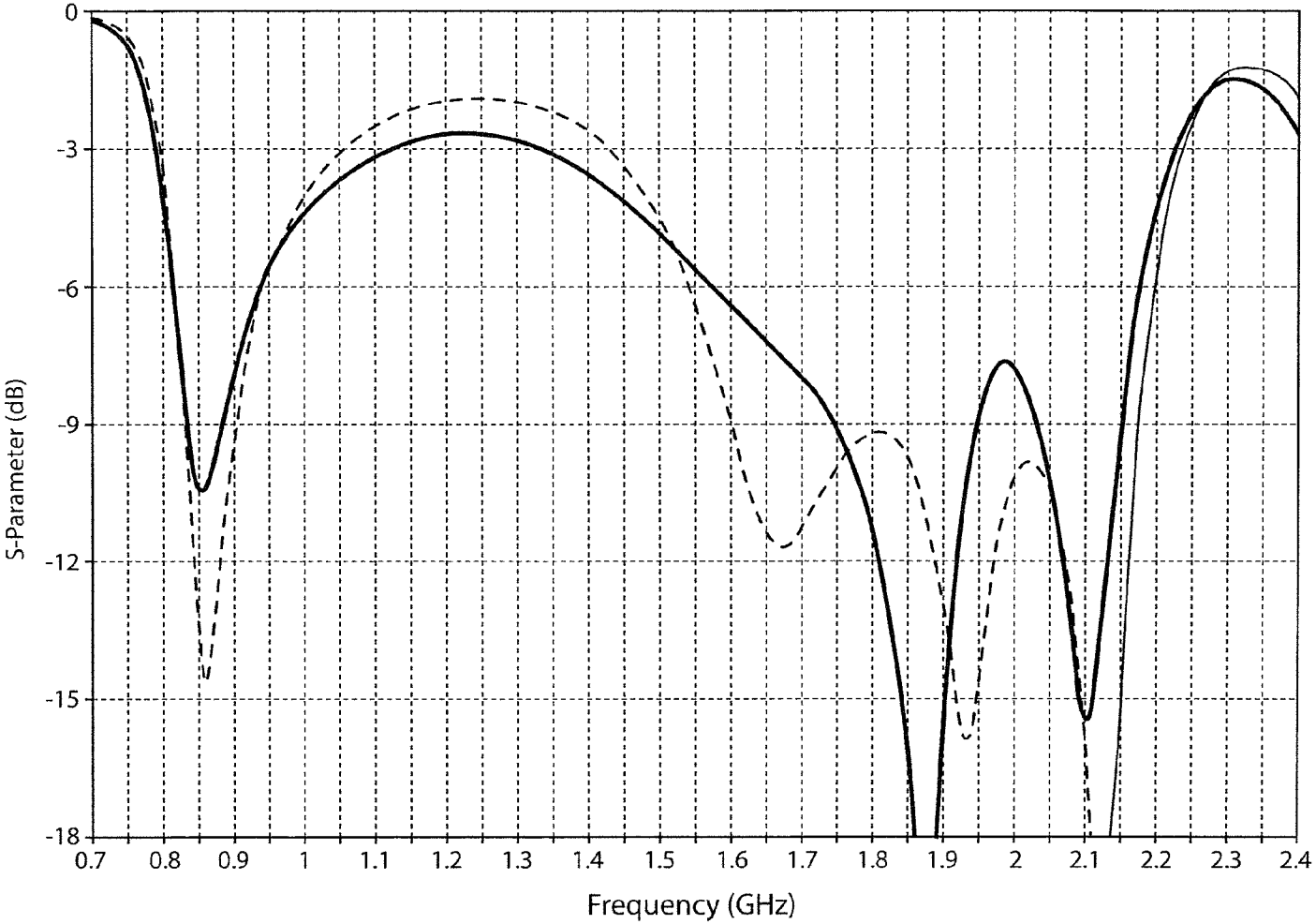
Figure 11:
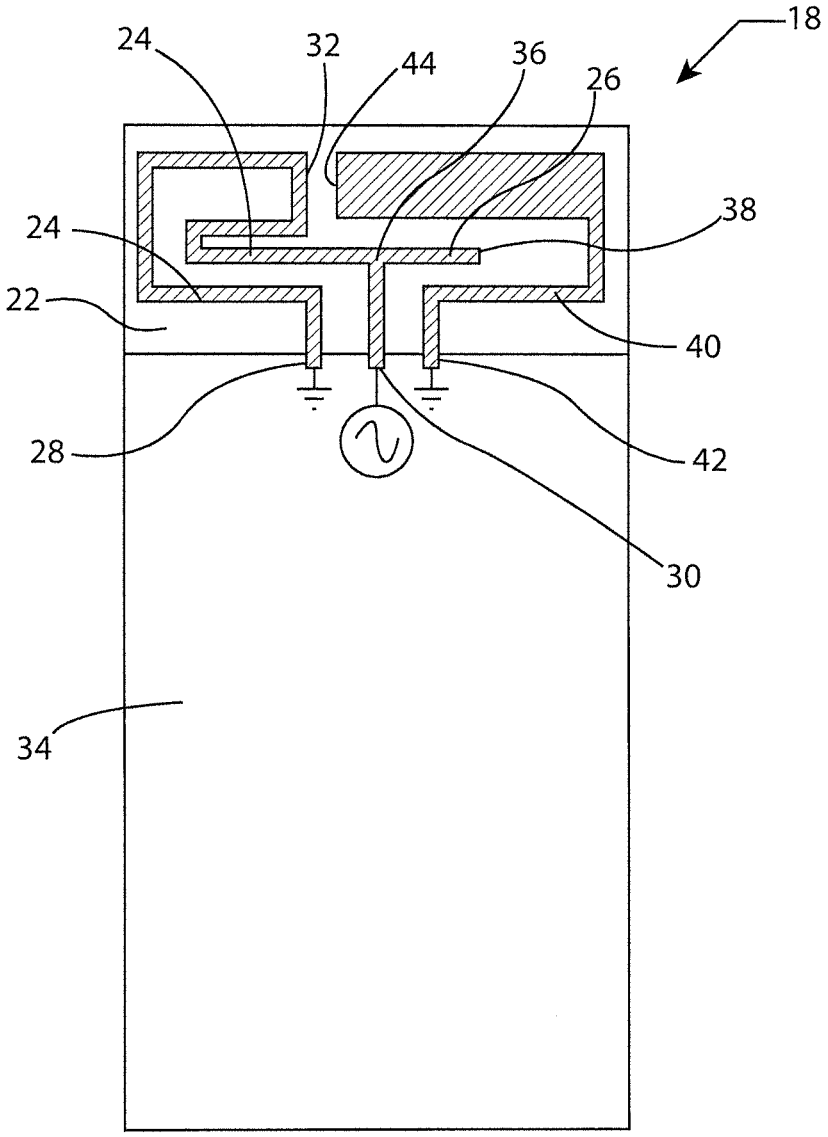

Having thus described some embodiments of the invention in general terms, reference will now be made to the accompanying drawings, which are not necessarily drawn to scale, and wherein:

FIG. 1 is a perspective view of a portable electronic device that includes an antenna in accordance with one embodiment of the present invention;

FIG. 2 is a block diagram illustrating the coupling of a ground plane and radio frequency circuitry to an antenna in accordance with one embodiment of the present invention;

FIG. 3 is a perspective view of an antenna in accordance with one embodiment of the present invention;

FIG. 4 is another perspective view of the antenna of FIG. 3 in accordance with an example embodiment of the present invention;

FIG. 5 is yet another perspective view of the antenna of FIG. 3 in accordance with an example embodiment of the present invention;

FIG. 6 is a plan view of the antenna of FIGS. 3-5 in accordance with an example embodiment of the present invention;

FIG. 7 is a graphical representation of the S-parameter response of an antenna in accordance with an example embodiment of the present invention as a function of frequency;

FIG. 8 is a Smith chart that provides an impedance view of the S-parameter response of FIG. 7;

FIGS. 9 and 10 are a graphical representations of the S-parameter response of antennas in accordance with other example embodiments of the present invention as a function of frequency; and FIG. 11 is a plan view of a two dimensional antenna in accordance with another embodiment of the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

Additionally, as used herein, the term 'circuitry' refers to (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

As defined herein, a "computer-readable storage medium," which refers to a non-transitory physical storage medium (e.g., volatile or non-volatile memory device), can be differentiated from a "computer-readable transmission medium," which refers to an electromagnetic signal.

A variety of portable electronic devices may include one or more antennas for supporting wireless communications with another device, with a network or otherwise. Although one example of a portable electronic device 10 is illustrated in FIG. 1, a portable electronic device that includes an antenna for supporting wireless communications may be embodied in various manners such as a PDA, mobile telephone, smartphone, pager, mobile television, gaming device, laptop computer, camera, tablet computer, touch surface, video recorder, audio/video player, radio, electronic book, positioning device (e.g., GPS device), or any combination of the aforementioned, and other types of voice and text communications systems. A portable electronic device may include a housing 12 that protects a number of internal components. In the illustrated embodiment, the portable electronic device also includes a display 14 and one or more buttons 16 for providing user input. In other embodiments in which the display is a touch screen, the portable electronic device may optionally include one or more buttons. As such, the portable electronic device of some embodiments in which the display is a touch screen may not include any buttons.

As shown in FIG. 2, the internal components of a portable electronic device 10 may include, among other components, one or more antennas 18, a system ground, such as a ground plane 34 as discussed below, and radio frequency circuitry 20. The radio frequency circuitry 20 may be any means such as a device or circuitry embodied in either hardware or a combination of hardware and software that is configured to receive and/or transmit voice, data or voice and data simultaneously via the antenna 18. The radio frequency circuitry may include, for example, a transmitter, a receiver, a transceiver or the like. In an embodiment in which the system ground is established by a ground plane, the portable electronic device may include a printed wiring board (PWB)

with the ground plane being incorporated as at least one layer therewithin. However, the portable electronic device may define system ground, such as providing a ground plane in other manners that are independent of a PWB, such as being provided by other conductive components of the device like, and not limited to, batteries, electromagnetic shielding enclosures, conductive housing parts or other conductive electrical or mechanical components. The ground plane may therefore be two dimensional or three dimensional.

Although the antenna 18 may be positioned at various locations within the housing 12 of the portable electronic device 10, the antenna of one embodiment is positioned proximate one end of the housing. The antenna may be configured to support wireless communications in one or more frequency bands. By way of example, but not of limitation, the antenna of one embodiment may be configured to support wireless communications in the pentaband, such as the frequency bands utilized by global systems for mobile communications (GSM) and wideband code division multiple access (WCDMA) networks, and in the frequency band(s) that support GPS (e.g., 1.575 GHz and 1.598 GHz-1.606 GHz). As described below, the antenna of this embodiment may include both a wide bandwidth and multiple frequency bands including, for example, both one or more lower frequency bands and one or more higher frequency bands.

As shown in FIGS. 3-6, the antenna 18 of one embodiment includes a feeding arm and a parasitic element 40. Both the feeding arm and the parasitic element of one embodiment may be formed of a conductive material, such as copper (Cu), nickel (Ni) plated Cu or Ni-gold (Ni—Au) plated Cu that is deposited upon a substrate 22, such as an insulative substrate that may be formed, for example, of a polycarbonate (PC) or a PC blended with acrylonitrile butadiene styrene polymer (ABS). In one embodiment the feeding arm and parasitic element 40 may be fabricated on a flexible-printed wiring board or flexi-circuit and attached to a suitable insulative substrate or carrier shaped so as to provide the required antenna arrangement in two or three dimensions, as required. The substrate or carrier may be formed by at least a part of a housing of the device. The flexi-circuit may be heat-staked to at least a part of the substrate or carrier. The conductive material used to form the feeding arm and parasitic element 40 may be provided by sheet metal or any other method of producing conductive material to form an antenna arrangement in two or three dimensions. The feeding arm and parasitic element 40 may be provided by molded interconnect device (MID) technology or laser direct structuring (LDS) as is known in the art. The antenna arrangement comprising the feeding arm including the elongated conductive excitation arm, and parasitic element may also be provided as a module, including the substrate or carrier, the conductive elements, and any coupling or connecting mechanisms. In other words the module is a complete component which may be produced separately to the portable electronic device and ground plane.

The feeding arm includes a conductive loop antenna portion 24 and an elongated conductive excitation arm portion 26. The loop antenna portion defines a loop formed of first and second legs comprised of a plurality of conductive traces that extend from a first end 28 and from a second end 30, opposite the first end, respectively and that are connected at a distal end 32. The first end of the loop antenna portion is configured to be grounded, such as by being electrically coupled to a ground plane 34. The electrical coupling maybe provided either by galvanic coupling or by electromagnetic coupling methods as is known in the art. In contrast, the second end of the loop antenna portion is configured to be fed or driven by the radio frequency circuitry 20. As such, the loop antenna portion is a magnetic field dominant radiation structure.

As a result of its loop configuration, the loop antenna portion 24 extends continuously from the first end 28 to the second end 30. In the illustrated embodiment, the loop antenna portion includes first conductive traces proximate the first and second ends that extend in parallel in the +Z direction along a first face of the insulative substrate 22. The loop antenna portion of the illustrated embodiment also includes second conductive traces that extend in parallel from the first conductive traces in the +Y direction along an upper face of the insulative substrate, third conductive traces that extend in parallel from the second conductive traces in the −X direction along the upper face of the insulative substrate, fourth conductive traces that extend in parallel from the third conductive traces in the −Z direction along a side face of the insulative substrate, fifth conductive traces that extend in parallel from the fourth conductive traces in the +Y direction along the side face of the insulative substrate and sixth conductive traces that extend in parallel from the fifth conductive traces in the +X direction along a second face of the insulative substrate, opposite the first face, to the distal end 32, at which the sixth conductive traces are connected. Although the majority of the loop antenna portion of one embodiment has the same width, the distal end of the loop antenna portion may be wider, such as shown in FIG. 3. Although one configuration of a loop antenna portion is illustrated in FIGS. 3-6 and is described above, the loop antenna portion may have other configurations.

In addition to the loop antenna portion 24, the feeding arm includes an excitation arm portion 26. The excitation arm portion is a monopole that is coupled, e.g., electrically or galvanically connected, at a first end 36 to the loop antenna portion and that extends outwardly therefrom to an open end 38, opposite the first end. Thus, the excitation arm portion is a predominantly electric field radiating structure. The excitation arm portion projects away from the loop antenna portion and does not extend into an interior region defined by the loop antenna portion. The excitation arm portion may be coupled to the loop antenna portion at various locations along the loop antenna portion. In one embodiment, however, the excitation arm portion is coupled to the loop antenna portion at a location closer to the second end 30 of the loop antenna portion than to the first end 28 of the loop antenna portion. Thus the excitation arm portion 26 is coupled closely to the second end 30 of the loop antenna portion 24, where the second end 30 is coupled to radio frequency circuitry 20. Further, the excitation arm portion of one embodiment may be coupled to the loop antenna portion at a location that is closer to the second end of the loop antenna portion than to the distal end 32 of the loop antenna portion. In the illustrated embodiment, the excitation arm portion is coupled to the loop antenna portion at a location upon an upper face of the insulative substrate 22 at which the second leg of the loop antenna portion that terminates with the second end turns or makes a corner in transitioning from the second conductive trace to the third conductive trace such that the second leg of the loop antenna portion extends or continues in one direction along the upper face of the insulative substrate 22, while the excitation arm portion extends in the opposite direction along the upper face of the insulative substrate.

The excitation arm portion 26 may extend for any of various lengths along the upper face of the insulative substrate 22. In one embodiment, however, the excitation arm portion extends a distance along the upper face of the insulative substrate that is less than the distance that the second leg of the loop antenna portion 24, e.g., the third conductive trace, extends along the upper face of the insulative substrate.

The parasitic element 40 extends from a first end 42 that is configured to be grounded, such as by being electrically coupled to the ground plane 34, to a second end 44, opposite the first end, that is open. The open second end 44 is not galvanically coupled to ground or to radio frequency circuitry. Thus, like the excitation arm portion 26, the parasitic element is a predominantly electric field radiating structure. The parasitic element is configured to wrap at least partially about the excitation arm portion. In this regard, the excitation arm portion is considered to be wrapped by the parasitic element since the parasitic element extends along opposite sides of the excitation arm portion. In the illustrated embodiment, the parasitic element extends along a majority of each of the opposite sides of the excitation arm portion so as to be wrapped about a substantial periphery of the excitation arm portion, such as by being wrapped about at least 90% of the excitation arm portion, as measured along the length of the excitation arm portion from its first end 36 to the opposed open end 38. The wrapping of the parasitic element about the excitation arm portion facilitates the coupling, such as the tight coupling, of the excitation arm portion and the parasitic element.

In this regard, the parasitic element 40 of the illustrated embodiment extends in the X direction on the upper face of the insulative substrate 22 in parallel to, but spaced apart from, a first side of the excitation arm portion 26. The parasitic element of the illustrated embodiment extends in the +X direction beyond the open end 38 of the excitation arm portion and is then turned so as to extend in the X direction along the second face of the insulative substrate so as to again extend in parallel, but spaced apart from, a second side, opposite the first side, of the excitation arm portion. As will be noted, the second end 44 of the parasitic element may extend beyond the first end 36 of the excitation arm portion at which the excitation arm portion is coupled to the loop antenna portion 24. As such the second end of the parasitic element may be located proximate an intermediate segment of the loop antenna portion between the first and second ends 28, 30 of the loop antenna portion. In the illustrated embodiment, the intermediate segment is proximate the first end of the excitation arm portion. Although the excitation arm portion is at least partially and, in some embodiments, almost entirely wrapped by the parasitic element, the parasitic element does not wrap about the loop antenna portion. While the second end of the parasitic element may be proximate an intermediate segment of the loop antenna portion, the parasitic element does not wrap about the loop antenna portion since the parasitic element is not positioned on opposite sides thereof.

As noted above, the first end 28 of the loop antenna portion 24 and the first end 42 of the parasitic element 40 may be grounded, such as by being coupled to the ground plane 34. In the illustrated embodiment, the ground plane defines a surface area that extends to the first end of the loop antenna portion and the first end of the parasitic element. Other portions of the loop antenna portion and the parasitic element extend beyond the surface area of the ground plane such that the ground plane of this embodiment does not extend alongside, e.g., underneath, the insulative substrate 22 and, as such, does not extend into alignment with other portions of the feeding arm and the parasitic element. However, mechanically supportive low loss (to radio frequencies) material may be placed underneath the antenna 18, such as and not limited to, PC/ABS plastic, FR4 printed wiring board substrates without copper layers, and any other type of suitable moldable or non-moldable plastics and non-conductive materials. The mechanically supportive material may be provided to support the antenna 18 and hold it in place.

In operation, radio frequency signals are coupled to the second end 30 of the loop antenna portion 24 so as to enable transmission and/or reception of radio frequency signals by the antenna 18. The coupling of the excitation arm portion 26 and the parasitic element 40 allows the antenna to have a wide bandwidth for multiple bands, such as both lower frequency bands and higher frequency bands, e.g., GSM 850 (WCDMA V), GSM 900 (WCDMA VIII), GSM 1800 (WCDMA III), GSM 1900 (WCDMA II) and WCDMA I, as well as GPS L1 (1.575 GHz) and global navigation satellite system (GLONASS) (1.598 GHz-1.606 GHz). Additionally, the loop antenna portion provides an additional high frequency band resonance and further provides a self-matching capability. As such, the antenna of one embodiment is a relatively highly efficient radiating structure that may support wireless communication in various frequency bands while maintaining a desirable gain, such as by supporting wireless communications in the pentaband and in the frequency bands that support GPS.

By way of example, FIGS. 7 and 8 are graphical representations of the S-parameter responses of an antenna 18 of an example embodiment of the present invention, which illustrate the manner in which the antenna is impedance matched versus frequency. FIG. 7 illustrates the magnitude of the return loss in dB as a function of frequency in GHz, while FIG. 8 is a Smith chart that provides an impedance view of the return loss of the same antenna. In one instance, a return loss of 6 dB or greater is considered an acceptable level of match between the radio frequency circuitry 20 and the antenna in that minimal power is reflected back from the antenna toward the radio circuitry. Relative to FIGS. 7 and 8, the scale associated with the S-parameter response is negative since the return loss is a loss. As such, an S-parameter response of −6 dB or less will be considered to provide an acceptable match in one embodiment. In FIG. 7, the frequency bands that are shaded are those frequency bands that may be utilized for the pentaband and for GPS. As shown, the antenna of this embodiment has a return loss of −6 dB or less throughout each of the frequency bands of interest, thereby providing an efficient radiating structure that is well matched and resonant within the various frequency bands of interest.

FIGS. 9 and 10 illustrate the magnitude of the return loss in dB as a function of frequency in GHz for antennas 18 in accordance with other embodiments of the present invention. In FIG. 10, the return loss as a function of frequency is shown with a solid line for an antenna without a matching network and with a dashed line for an antenna with a matching network. As shown by FIGS. 9 and 10, the antennas of these other embodiments also generally provide an acceptable return loss in the frequency bands of interest including both lower frequency bands and higher frequency bands.

However, the antenna 18 may be constructed in a manner that permits the antenna of one embodiment to remain relatively small so as to permit the antenna to be disposed within the housing 12 of a portable electronic device 10 while permitting the portable electronic device to remain relatively small. Although the antenna, including the insulative substrate 22 that supports the antenna, may have various sizes, the antenna of one embodiment may have a size that is no larger than 5 mm×7 mm×60 mm for a volume of about 2.1 $cm^3$.

In an embodiment, the antenna 18 may alternatively be only two dimensional or planar such that the antenna 18 illustrated in the three dimensional embodiment of FIGS. 3-6 is flattened. An example of a two dimensional antenna in accordance with this alternative embodiment is shown in FIG. 11. As shown in FIG. 11, the two dimensional antenna of this alternative embodiment also includes a feeding arm including a conductive loop antenna portion 24 and an elongated excitation arm portion 26, as well as a parasitic element 40 that extends along opposite sides of the excitation arm portion so as to wrap at least partially about the excitation arm portion, as described above in conjunction with the three dimensional embodiment. The two dimensional antenna of this embodiment would provide a very thin antenna solution which may be preferable to some designs of portable electronic device where thinness is more important. The same effects may be maintained in the planar version as found in the non-planar version.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. An apparatus comprising:

a feeding arm comprising a conductive loop antenna portion and an elongated conductive excitation arm portion, wherein the loop antenna portion extends from a first end that is configured to be grounded to a second end, the second end being configured to be driven by radio frequency circuitry, and wherein the excitation arm portion is coupled at a first end to the loop antenna portion and extends outwardly therefrom to an open end; and a parasitic element comprising a first end that is configured to be grounded and a second end configured to be open, wherein the parasitic element extends from the first end to the second end, and wherein the parasitic element extends along opposite sides of the excitation arm portion so as to wrap at least partially about the excitation arm portion and be coupled thereto.

2. An apparatus according to claim 1 wherein the parasitic element extends along a majority of each of the opposite sides of the excitation arm portion so as to be wrapped about a substantial periphery of the excitation arm portion.

3. An apparatus according to claim 1 wherein the parasitic element is only wrapped about the excitation arm portion.

4. An apparatus according to claim 1 wherein the second end of the parasitic element is proximate an intermediate segment of the loop antenna portion between the first and second ends.

5. An apparatus according to claim 4 wherein the intermediate segment is proximate the first end of the excitation arm portion.

6. An apparatus according to claim 1 further comprising a ground plane coupled to the first end of the loop antenna portion and the first end of the parasitic element, wherein the ground plane defines a surface area that extends to the first end of the loop antenna portion and the first end of the parasitic element, and wherein at least portions of the feeding arm and the parasitic element extend beyond the surface area of the ground plane.

7. An apparatus according to claim 1 wherein the first end of the excitation arm portion is coupled to the loop antenna portion at a location closer to the second end than to the first end of the loop antenna portion.

8. An apparatus according claim 1 wherein the loop antenna portion comprises a magnetic field dominant radiation structure, and wherein both the excitation arm portion and the parasitic element comprise predominantly electric field radiating structures.

9. A portable electronic device comprising an apparatus as claimed in claim 1.

10. A module comprising an apparatus as claimed in claim 1.

11. A method comprising:

providing an antenna comprising a feeding arm and a parasitic element, wherein the feeding arm comprises a conductive loop antenna portion and an elongated conductive excitation arm portion, wherein the loop antenna portion extends from a first end that is grounded to a second end, wherein the excitation arm portion is coupled at a first end to the loop antenna portion and extends outwardly therefrom to an open end, and wherein the parasitic element extends from a first end that is grounded to a second end that is open, and wherein the parasitic element extends along opposite sides of the excitation arm portion so as to wrap at least partially about the excitation arm portion and be coupled thereto; and coupling radio frequency signals to the second end of the loop antenna portion.

12. A method according to claim 11 wherein providing the antenna comprises providing the antenna such that the parasitic element extends along a majority of each of the opposite sides of the excitation arm portion so as to be wrapped about a substantial periphery of the excitation arm portion.

13. A method according to claim 11 wherein providing the antenna comprises providing the antenna such that the parasitic element is only wrapped about the excitation arm portion.

14. A method according to claim 11 wherein providing the antenna comprises providing the antenna such that the second end of the parasitic element is proximate an intermediate segment of the loop antenna portion between the first and second ends.

15. A method according to claim 14 wherein the intermediate segment is proximate the first end of the excitation arm portion.

16. A method according to claim 11 wherein providing the antenna comprises providing the antenna which further comprises a ground plane connected to the first end of the loop antenna portion and the first end of the parasitic element, wherein the ground plane defines a surface area that extends to the first end of the loop antenna portion and the first end of the parasitic element, and wherein at least portions of the feeding arm and the parasitic element extend beyond the surface area of the ground plane.

17. A method according to claim 11 wherein providing the antenna comprises providing the antenna such that the first end of the excitation arm portion is coupled to the loop antenna portion at a location closer to the second end than to the first end of the loop antenna portion.

* * * * *